US009963661B2

(12) United States Patent
Ouali et al.

(10) Patent No.: US 9,963,661 B2
(45) Date of Patent: May 8, 2018

(54) HYBRID PERFUME MICROCAPSULES

(71) Applicant: Firmenich SA, Geneva (CH)

(72) Inventors: Lahoussine Ouali, Geneva (CH); Marlène Jacquemond, Geneva (CH); Philipp Erni, Geneva (CH)

(73) Assignee: Firmenich SA, Geneva (CH)

( * ) Notice: Subject to any disclaimer, the term of this patent is extended or adjusted under 35 U.S.C. 154(b) by 0 days. days.

(21) Appl. No.: 15/322,155

(22) PCT Filed: Jun. 25, 2015

(86) PCT No.: PCT/EP2015/064359

§ 371 (c)(1),
(2) Date: Dec. 26, 2016

(87) PCT Pub. No.: WO2015/197757

PCT Pub. Date: Dec. 30, 2015

(65) Prior Publication Data

US 2017/0137757 A1 May 18, 2017

(30) Foreign Application Priority Data

Jun. 27, 2014 (EP) ..... 14174803

(51) Int. Cl.

| | |
|---|---|
| ***C11D 3/50*** | (2006.01) |
| ***C11D 17/00*** | (2006.01) |
| ***C11D 3/37*** | (2006.01) |
| ***C11D 11/00*** | (2006.01) |

(52) U.S. Cl.

CPC ..... *C11D 3/505* (2013.01); *C11D 3/3726* (2013.01); *C11D 3/3738* (2013.01); *C11D 11/0064* (2013.01); *C11D 17/0039* (2013.01)

(58) Field of Classification Search
None
See application file for complete search history.

(56) References Cited

U.S. PATENT DOCUMENTS

| | | | |
|---|---|---|---|
| 4,260,515 | A | 4/1981 | Sliwka |
| 4,898,696 | A | 2/1990 | Sliwka |
| 6,238,650 | B1 | 5/2001 | Lapidot et al. |
| 2002/0064654 | A1 | 5/2002 | Mengkui et al. |

(Continued)

FOREIGN PATENT DOCUMENTS

| | | |
|---|---|---|
| EP | 2500087 A2 | 9/2012 |
| KR | 20110112682 | 10/2011 |
| KR | 2013091556 | 8/2013 |

(Continued)

OTHER PUBLICATIONS

Bayer Materialscience: "Desmodur/Desmophen—Bayhydrol/Bayhydur—Roskydal Raw Materials for Automotive Refinish Systems," Dec. 24, 2012, pp. 7-8. XP002745666. Retrieved from the Internet: http://200.182.3.36/bpo/home.nsf/04bbd938b0f97149c1256ac500564711/7710c8878da245ab832570770063bb8e/$FILE/Repintura.pdf (retrieved on Oct. 8, 2015).

(Continued)

*Primary Examiner* — Aradhana Sasan
(74) *Attorney, Agent, or Firm* — Winston & Strawn LLP

(57) ABSTRACT

The present invention relates to organic-inorganic hybrid core-shell microcapsules encapsulating an active ingredient such as a perfume and having a shell made from the hydrolysis and condensation reaction of particular poly-alkoxysilane macro-monomeric compositions.

18 Claims, 5 Drawing Sheets

(56) References Cited

U.S. PATENT DOCUMENTS

2011/0118161 A1 5/2011 Looft

FOREIGN PATENT DOCUMENTS

| | | | |
|---|---|---|---|
| WO | WO2006131846 | A1 | 12/2006 |
| WO | WO2008098387 | A1 | 8/2008 |
| WO | WO2009106318 | A2 | 9/2009 |
| WO | WO2009147119 | A1 | 12/2009 |
| WO | WO2009153695 | A1 | 12/2009 |
| WO | WO2011124706 | A1 | 10/2011 |
| WO | WO2011154893 | A1 | 12/2011 |
| WO | WO2012107323 | A1 | 8/2012 |
| WO | WO2013068255 | A1 | 5/2013 |
| WO | WO2013083760 | A2 | 6/2013 |

OTHER PUBLICATIONS

International Search Report and Written Opinion, application PCT/EP2015/064359, dated Oct. 28, 2015.

Jacquemond et al., J. Applied Polymer Science, 2009, 114(5), p. 3074-80.

a) b)

HYBRID PERFUME MICROCAPSULES

This application is a 371 filing of International Patent Application PCT/EP2015/064359 filed 25 Jun. 2015, which claims the benefit of European patent application no 14174803.8 filed 27 Jun. 2014.

TECHNICAL FIELD

The present invention relates to polyalkoxysilane macro-monomeric compositions as well as their use in a process for the preparation of new core-shell microcapsules having a hybrid organic-inorganic shell and an active ingredient-based core, in particular a perfume-based core. The microcapsules obtained by such a process as well as perfuming compositions and consumer products containing those capsules are also objects of the present invention.

BACKGROUND OF THE INVENTION

The most challenging problem faced by the perfumery industry lies in the degradation and relatively rapid loss of the olfactive benefit provided by odoriferous compounds due respectively to their chemical structure and volatility, particularly that of "top-notes". In addition, perfume perception needs to be provided at the right moments during the application of perfumed consumer goods while ensuring perfume optimal impact. These problems are generally tackled using a delivery system, e.g. microcapsules containing a perfume, to protect and to release the fragrance in a controlled manner.

Over the past two decades, different types of core-shell microcapsules have been developed and disclosed in the prior art. Polymeric materials such as melamine-formaldehyde as those described for example in U.S. Pat. No. 4,260,515, U.S. Pat. No. 4,898,696, or WO2006131846, and polyurea described for example in US20020064654, WO2009153695 or WO2011154893, have been used to make the microcapsule membranes. In these cases, the microcapsule shell is either the product of a polycondensation process of a polymeric resin from the aqueous phase, or in the case of polyurea, the product of an interfacial polymerisation reaction between a polyisocyanate, soluble in the core, and a polyamine that is water soluble. The functionalisation and modification of these capsules are also well known and described for instance in WO2008098387 or in WO2012107323. Despite their performance in term of long-lastingness for particular perfume compositions and in specific applications, these microcapsules would still need to be further improved. In particular, the presence of residual monomers but also the limited storage stability of capsules in application or yet the restriction in term of perfume creation are limiting factors that compromise the business growth of these microcapsules. On the other hand the mechanical properties of core/shell microcapsules are important for their ability to deliver active ingredients. In particular, for capsules intended to release their load upon rubbing, the resistance of the capsule shell against mechanical forces is a key property. The desirable barrier properties of core/shell microcapsules formulated for optimum stabilization of the active ingredient are also linked to the mechanical properties of the capsules. Consequently, a common problem is that stable microcapsules may be optimized for stability, but they are mechanically too robust to be broken during the final application (such as the rubbing of a textile or skin). Therefore, it would be desirable to prepare microcapsules that exhibit mechanical properties such that they can easily be broken during the final application to release the active ingredient in a burst.

More recently, different approaches have been disclosed to improve core-shell microcapsules by developing formaldehyde-free aminoplast-based microcapsules as described in WO2013068255. Also, functional monomers have been introduced in polyurea membrane. For instance WO2009147119 discloses hybrid microcapsules wherein amino functionalized silane is reacted with polyisocyanates to form a hybrid capsule membrane. The developments in this area have also been using materials that are based on other silane compounds. In this regard, silane monomers such as tetraethoxysilane (TEOS), their analogues and functionalized versions have been largely described for use in the preparation of inorganic microcapsules for the encapsulation of diverse active ingredients including sunscreen products, e.g. in U.S. Pat. No. 6,238,650; and perfumes e.g. in WO2009106318, WO2011124706, or yet in EP2500087. Although, these capsules can be produced with reduced content of residual monomers, their membrane is usually highly porous whatever the monomer content, therefore implying a poor retention of low molecular weight molecules such as perfumery raw materials. A recent approach disclosed in WO2013083760 consisted in adjusting the process parameters starting from the formation and condensation of a mixture of polysilicones that cross-link to consolidate the membrane structure. Nevertheless, the capsules there-obtained are not satisfying as they demonstrate poor perfume retention which compromises their use in perfumery applications.

Despite the solutions described heretofore, there is therefore still a need within the perfumery industry to design a new generation of microcapsules with a good perfume retention and improved stability over a large range of pH values, while controlling their mechanical properties, and avoiding the generation or the presence of residual monomers.

The present invention addresses the problems mentioned above with stable core-shell microcapsules having a wall made from the hydrolysis and condensation reaction of a particular polyalkoxysilane macro-monomeric composition. Said composition also object of the invention can be introduced or prepared in situ in the oil phase during the process of preparation of the microcapsules.

SUMMARY OF THE INVENTION

It has been surprisingly discovered that by using a well-defined polyalkoxysilane macro-monomeric composition, microcapsules having an organic-inorganic hybrid wall and presenting very high perfume retention and improved mechanical properties could be produced.

In a first object, the invention therefore relates to a polyalkoxysilane macro-monomeric composition obtainable by reacting at least one compound of formula

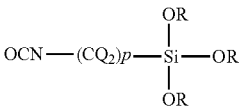

(i)

wherein NCO is an isocyanate group, R represents a $CH_3$, or $CH_2$—$CH_3$ group, Q represents H, a $CH_3$ or $CH_2$—$CH_3$ group and p is an integer comprised between 1 and 5, preferably between 2 and 5; with at least two different polyamines comprising each at least two amino groups.

A second object of the invention consists of a process for the preparation of organic-inorganic core-shell microcapsules, said process including the following steps:

a) Dissolving a polyalkoxysilane macro-monomeric composition as defined in the first object of the invention into an active ingredient, preferably a perfume to form an oil phase;

b) Preparing an aqueous phase by dissolving an emulsifier or a colloidal stabilizer in water, preferably at pH above 8;

c) Dispersing under high shearing the oil phase into the aqueous phase;

d) Keeping the resulting emulsion at pH preferably above 8 and temperature preferably higher than 60° C., more preferably higher than 80° C. to form hybrid microcapsules.

In a third object, the invention relates to organic-inorganic microcapsules obtainable by the process described above, said capsules comprising a fragrance-containing core and a shell resulting from the hydrolysis and condensation reaction of a polyalkoxysilane macro-monomeric composition as defined in the first object of the invention.

A perfuming composition and a perfumed consumer product comprising the microcapsules defined in the third object of the invention consist of a last object of the invention.

BRIEF DESCRIPTION OF THE DRAWINGS

FIG. 1(*a*) represents a sample before rubbing, FIG. 1(*b*) represents a sample after gentle rubbing.

DETAILED DESCRIPTION OF THE INVENTION

Figure 1:
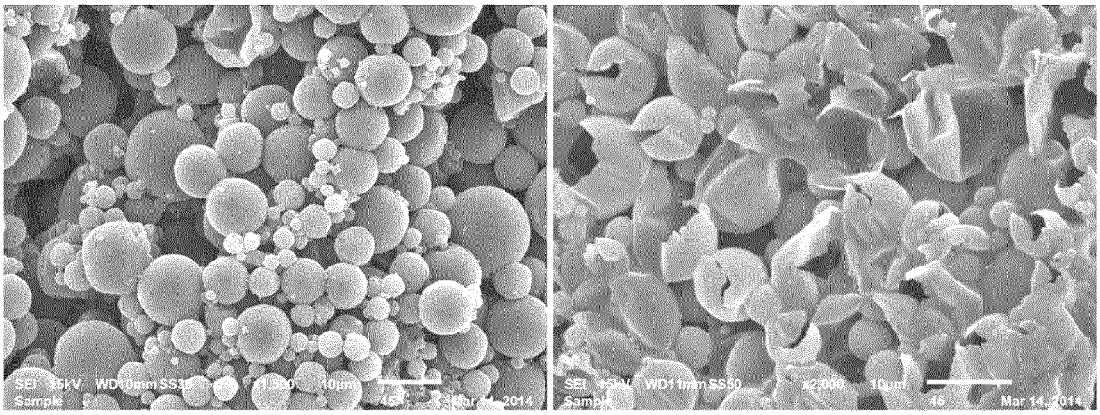
FIG. 1 shows micrographs of microcapsules according to the present invention obtained by Scanning Electron Microscopy.

Unless stated otherwise, percentages (%) are meant to designate percent by weight of a composition.

The present invention is based on the unexpected finding that the hydrolysis and condensation of newly generated polyalkoxysilane macro-monomeric composition at the oil-water interface could form organic-inorganic hybrid membrane leading to core-shell microcapsules with improved properties.

A first object of the invention therefore consists of a polyalkoxysilanes macro-monomeric composition obtainable by reacting at least one compound of formula

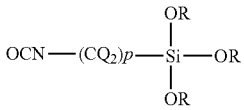

(i)

wherein NCO is an isocyanate group, R represents a $CH_3$, or $CH_2$—$CH_3$ group, Q represents H, a $CH_3$ or $CH_2$—$CH_3$ group and p is an integer comprised between 1 and 5, preferably between 2 and 5; with at least two different polyamines comprising each at least two amino groups. By "different" polyamines, what is meant is polyamines that do not have the same number and types of atoms. In particular isomers are not considered as different polyamines in the context of the invention. Said composition can advantageously be prepared from commercially available monomers prior to their use for the microencapsulation process and alternatively can be formed directly in the oil phase as part of the microcapsule preparation as described below. The use of compounds of formula (i) for microcapsule synthesis presents the further advantage of reduction or even absence of residual monomers content. In addition, the polyalkoxysilane macro-monomeric composition of the invention can be used to adjust the mechanical properties of microcapsules prepared therefrom, thereby controlling the perfume impact in the application.

Compound of formula (i) are preferably selected from the group consisting of 3(triethoxysilyl)propyl isocyanate and 3(trimethoxysilyl)propyl isocyanate.

The at least one compound of formula (i) is reacted with at least two different polyamines comprising each at least two amino groups. According to a first embodiment, the at least two different polyamines comprise each two amino groups. According to a second embodiment, the at least two different polyamines comprise each more than two amino groups.

The term "polyamine" in the context of the invention means a compound comprising at least two reactive amino groups which can be primary or secondary. By reactive amino groups it is meant groups susceptible of reacting with an isocyanate group. The polyamines can be aliphatic or aromatic. Examples of polyamines include those selected from the group consisting of 1,2-diaminopropane, 1,2-diaminocyclohexane, ethylenediamine, isobutylenediamine, 1,2-diaminocyclohexane and N,N'-dimethyl-1-2-diaminocyclohexane.

The total amount of polyamines is preferably adjusted so that the molar ratio of isocyanate groups from the at least one compound of formula (i) relative to amine groups from the at least two polyamines is comprised between 0.8 and 2. More preferably, said molar ratio is comprised between 1 and 1.5. The reaction between the alkoxysilaneisocyanate of formula (i) and the at least two polyamines, also referred to as "polyamine system" can be advantageously controlled if desired to prevent residual free isocyanate.

It has now been found that the above-described new macro-monomeric composition was able to hydrolyse and to condensate at a water/oil interface to form organic-inorganic hybrid membrane with advantageous properties.

A second object of the invention therefore consists of a process for the preparation of organic-inorganic core-shell microcapsules preferably comprising a fragrance-based core, said process including the following steps:

a) Dissolving a polyalkoxysilane macro-monomeric composition as defined above into an active ingredient, preferably a perfume to form an oil phase;

b) Preparing an aqueous phase by dissolving an emulsifier or a colloidal stabilizer in water, preferably at pH above 8;

c) Dispersing under high shearing the oil phase into the aqueous phase;

d) Keeping the resulting emulsion at pH preferably above 8 and temperature preferably higher than 60° C., more preferably higher than 80° C. to form hybrid microcapsules.

In a first step, a polyalkoxysilane macro-monomeric composition as defined above is dissolved into a perfume to form an oil phase. The invention can also be performed with another active ingredient than a perfume, that would benefit from an encapsulation, for instance, a dye, dye precursor, catalyst for chemical reactions, adhesive, reactive substance for adhesive applications, pharmaceutical active substance, cosmetic active substance, plant protection active substance (for example insecticide, fungicide, herbicide), water repellent, flame retardant, sunscreen agent or solvent. In the process of the invention, the formation of the polyalkoxysilane monomeric composition can either be performed in an organic solvent and then added to the oil phase or be directly performed in the perfume-containing oil phase. Since the amino groups are highly reactive with the isocyanate groups compared to hydroxyl groups, the presence of fragrance molecules bearing primary or secondary hydroxy groups do not affect the present microencapsulation process in the case where the macro-monomeric composition is directly formed within the perfume-containing oil phase. This is another advantage of the present invention when compared to polyurea or polyurethane microcapsules, as there is therefore no limitation with regard to the perfume composition.

According to a particular embodiment, the amount of polyalkoxysilane macro-monomer composition, is preferably adjusted to range between 1 to 50% of the oil phase, more preferably between 5 and 30% of the oil phase.

By "perfume" (or also "perfume oil") it is meant a perfume that is liquid at about 20° C. According to any one of the above embodiments said perfume oil in which the polyalkoxysilane macro-monomeric composition is dissolved in step a) can be a perfuming ingredient alone or a mixture of ingredients. As a "perfuming ingredient" it is meant here a compound, which is used in a perfuming preparation or composition to impart a hedonic effect or to modulate e.g. prolong the odour of the composition. In other words such an ingredient, to be considered as being a perfuming one, must be recognized by a person skilled in the art as being able to impart, modify or modulate in a positive or pleasant way the odor of a composition, and not just as having an odor. For the purpose of the present invention, malodor counteracting ingredients and anti-habituating ingredients are also encompassed by the definition of "perfuming ingredients".

The nature and type of the perfuming ingredients present in the perfume oil do not warrant a more detailed description here, which in any case would not be exhaustive, a skilled person in the art being able to select them on the basis of his general knowledge and according to the intended use or application and the desired organoleptic effect sought. In general terms, these perfuming ingredients belong to chemical classes as varied as alcohols, aldehydes, ketones, esters, ethers, acetates, nitriles, terpenoids, nitrogenous or sulphurous heterocyclic compounds and essential oils, and said perfuming ingredients can be of natural or synthetic origin. Many of these ingredients are in any case listed in reference texts such as the book by S. Arctander, Perfume and Flavor Chemicals, 1969, Montclair, N.J., USA, or its more recent versions, or in other works of a similar nature, as well as in the abundant patent literature in the field of perfumery. It is also understood that said ingredients may also be compounds known to release in a controlled manner various types of perfuming compounds.

The perfuming ingredient(s) to be encapsulated may be dissolved in a solvent of current use in the perfume industry thus the core of the capsule might be pure perfuming ingredients or a mixture of perfuming ingredients in an adequate hydrophobic solvent. The solvent is preferably not an alcohol. Examples of such solvents are diethyl phthalate, isopropyl myristate, Abalyn® (rosin resins, trademark from Eastman), benzyl benzoate, ethyl citrate and isoparaffins. Preferably, the perfume oil comprises less than 20% and more preferably less than 10% of solvent, all these percentages being defined by weight relative to the total weight of the perfume. Most preferably, the perfume is essentially free of solvent.

According to a particular embodiment of the invention, the perfume used in the process of the invention might contain primary alcohols, secondary alcohols and tertiary alcohols without any restriction on their amounts. Nevertheless, their amounts can be restricted if their presence negatively affects the stabilisation of the emulsion during the hydrolysis and condensation of the silane monomers. Same statement can be made for aldehyde fragrance molecules.

According to a particular embodiment, the oil phase consists essentially of the perfume oil and the polyalkoxysilane macro-monomeric composition.

According to the process of the invention, an aqueous phase is prepared by dissolving an emulsifier or a colloidal stabilizer in water, preferably at a pH above 8. Examples of such emulsifier or colloidal stabilizer are acylglycinate salts (such as that sold by Ajinomoto under the trade name Amilite®), polyvinylalcohol, anionic polyvinyl alcohol (such as that sold by Kuraray under the trade name Mowiol® KL-506), cationic polyvinylalcohol (C506, from Kuraray), polyvinylpyrrolidone. Cellulose polymers, for example sodium carboxymethylcellulose polymers, such as those sold by Hercules under the trade name Ambergum®, hydroxypropylcellulose, hydroxyethylcellulose, carboxymethylcellulose. One can also use ligninsulfonic sodium salt, pectins, soy proteins, gum arabic, gelatine or casein and albumin derived emulsifiers.

In the next step of the process of the invention, the oil phase is dispersed under high shearing into the aqueous phase. Standard shearing equipment is used to disperse the perfume phase in water and to adjust the average size of the resulting emulsion. The resulting emulsion is then kept at pH preferably above 8 and a temperature preferably higher than 60° C. to form the hybrid microcapsules.

The organic-inorganic hybrid membrane of the microcapsules formed by the process of the invention is the result of the interfacial hydrolysis and condensation of the polyalkoxysilane macro-monomers. The perfume phase content ranges between 5 and 50% of the total weight of the emulsion, more preferably between 10 and 40%. The average size of the emulsion is comprised between 1 and 100 um, more preferably between 5 and 50 um.

The process of the invention advantageously allows the adjustment of the organic-inorganic structure which leads to the improvement of the perfume retention when the microcapsules are stored in end products containing high amount of surfactants.

Organic-inorganic core-shell microcapsules obtainable by a process as defined above comprising a fragrance-containing core and a shell resulting from the hydrolysis and condensation reaction of a polyalkoxysilane macro-monomeric composition as defined above are also an object of the invention. The specific composition of the present microcapsules wall allows to obtain microcapsules that are at the fine balance between perfume retention and impact so as to achieve satisfactory slow and constant release of fragrances over time, once the capsules are applied onto a surface such as for example human skin or hair, while showing the desired stability in the product base (e.g. counteracts efficiently the extraction of the perfume by the surfactants of the consumer product).

The microcapsules of the present invention can comprise other optional ingredients such as antioxidants and antimicrobial or antifoaming agents.

The microcapsules of any embodiment of the invention preferably have a mean diameter comprised between 1 and 50 μm and preferably comprised between 5 and 30 μm. In the present context, "mean diameter" refers to the arithmetic mean.

The microcapsules of the present invention bear anionic or cationic charges over a broad range of pH ranging from acidic to basic pH and can be characterised by their Zeta potential. For the purpose of the present invention, the Zeta potential is defined as measured using Zetasizer Nano ZS (Malvern Instruments).

The capsules of the present invention can be provided in a dry form or in the form of a liquid composition or slurry comprising a suspension of the capsules in water, such as for example that obtained directly in the end of the preparation process described in the examples below. In such liquid composition, the amount of water is preferably comprised between 50 and 90% by weight, relative to the total weight of the composition. A liquid aqueous composition comprising microcapsules are defined above; together with a cationic polymer is also an object of the invention.

The microcapsules of the invention can be advantageously used for the controlled release of an encapsulated perfume. It is therefore particularly appreciated to include these microcapsules as perfuming ingredients in a perfuming composition or in a perfumed consumer product. The result is highly surprising since said consumer products may contain high amounts (typically more than 10% of their own weight) of specific types of surfactant/tensioactive/solvents which are known to significantly diminish the stability and the performance of capsules. In other words, the use of the invention's microcapsules in consumer products provides unexpected advantages over the same use of other similar prior art capsules.

As shown in FIG. 1, the organic-inorganic hybrid microcapsules obtained by the process of the invention are also easily breakable. In fact, only a slight or gentle rubbing is enough to break their membrane and by following to release the fragrance. This property provides a strong increase of the perfume impact during the perfumery application. The capsules according to the invention also present a good stability and thus a good retention of the perfume in application. The microcapsules are also well dispersed in the consumer product bases, so that no phase separation is induced upon addition of the capsules to the base and during a sufficient storage period. The microcapsules of the invention finally provide a controlled release of the encapsulated perfume, said perfume being slowly released from the microcapsules, thus considerably improving the perfume long-lastingness and intensity.

A perfumed consumer product or a perfuming composition comprising the microcapsules of the invention or the liquid aqueous composition of the invention is therefore also an object of the present invention. In particular the consumer product may be in the form of a home- or personal-care product. Preferably, it is in the form of a liquid shampoo, hair conditioner, shower gel, antiperspirant, deodorant, detergent, all-purpose cleaner or fabric softener, in the form of soap or in the form of powder or tablet detergent. As detergents we include here products such as detergent compositions or cleaning products for washing up or for cleaning various surfaces, for example intended for the treatment of textiles, dishes or hard surfaces (floors, tiles, stone-floors, etc), preferably for the treatment of textile. Preferred consumer products according to the present invention are shower gels, hair care products such as shampoos and hair conditioners, antiperspirants and deodorants, among which shower gels and hair care products are mostly preferred.

The reaction mixture obtained in the process of the invention may be used as such to perfume the consumer products. Alternatively, the microcapsules obtained in the process of the invention may be isolated from the reaction mixture before being incorporated into a consumer product. Similarly, the reaction mixture comprising the microcapsules of the invention may be sprayed onto a dry, powdered product, such as a washing powder or powdered detergent or the microcapsules may be dried and added to these products in solid form.

In order to further improve the deposition of the capsules on the substrate to which they are applied, the capsules of the present invention can advantageously be incorporated in the consumer product of the present invention together with a cationic polymer. Such cationic polymer preferably comprises a hydrophobic moiety. The main examples of cationic polymers known to be substantive to hair and skin include quaternized synthetics, cellulose derivatives, quaternized guars, lanolin, animal and vegetable proteins, and aminosilicones. Examples of such cationic polymers include cationic cellulosic guar hydroxypropyl triammonium polymers (such as for example those sold by Rhodia under the trade name Jaguar®), similarly modified hydroxypropyl trimethyl ammonium chloride ether of hydroxyethyl celluloses such as the Polyquaternium 10 UCare Polymers JR, LR and LK supplied by Amerchol Corporation, acrylamido-propyl trimonium choride/acrylamide copolymers (such as the ones sold by BASF under the trade name Salcare®), polyquaternium polymers, among which copolymers of polyvinyl pyrrolidone and polyvinylimidazole (such as those sold by BASF under the trade name Luviquat® Ultra Care), cationic acrylates (such as the Merquat® copolymers of dimethyl diallyl ammonium chloride with acrylamide sold by NALCO). Other quaternized materials such as quaternized lanolin, chitosan, collagen and wheat proteins are also valid cationics. Finally, aminosilicones such as Quaternium 80 (ABILQUATS 3270, 3272 sold by Goldschmidt) may also be used. The capsules of the present invention are able to interact in a very efficient way with such cationic polymers, so that the deposition of the capsules onto surfaces to which they are applied, especially on skin, hair or fabric, is further improved.

Preferably, the consumer product of the present invention comprises a sufficient amount of capsules to achieve a perfume content in the final product comprised between 0.01 and 10%, preferably between 0.1 to 2% by weight, relative to the total weight of the consumer product. When the capsules are added to a consumer product in the form of a slurry as obtained directly from the process described below, this corresponds to an amount of such slurry comprised between 0.02 and 30%, more preferably between 0.1 and 5% by weight relative to the total weight of the consumer product. Of course the above concentrations may be adapted according to the olfactive effect desired in each product.

Formulations of consumer product bases in which the microcapsules of the invention can be incorporated can be found in the abundant literature relative to such products. These formulations do not warrant a detailed description here, which would in any case not be exhaustive. The person skilled in the art of formulating such consumer products is perfectly able to select the suitable components on the basis of his general knowledge and of the available literature.

The invention will now be described in further details by way of the following examples, which should not be considered as limiting the invention. In the examples, unless otherwise specified, the abbreviations have the usual meaning in the art and the temperatures are indicated in degrees centigrade (° C.).

EXAMPLES

Example 1

Preparation of Microcapsules According to the Invention

A perfume was prepared by admixing the ingredients from Table 1 below.

TABLE 1

| perfume composition | |
|---|---|
| Ingredient | Amount [%] |
| Hexyl salicylate | 20 |
| Romascone ® [1)] | 20 |
| Cyclosal [2)] | 20 |
| Vertenex ® [3)] | 20 |
| Verdox ® [4)] | 20 |

[1)] methyl 2,2-dimethyl-6-methylene-1-cyclohexanecarboxylate, origin and trademark from Firmenich SA, Geneva, Switzerland;
[2)] (+−)-3-(4-isopropylphenyl)-2-methylpropanal, origin: Firmenich SA, Geneva, Switzerland;
[3)] 4-tert-butyl-1-cyclohexyl acetate, origin and trademark from International Flavors and Fragrances, USA;
[4)] 2-tert-butyl-1-cyclohexyl acetate, origin and trademark from International Flavors and Fragrances, USA.

Preparation of the Oil Phase (Polyalkoxysilane Macro-Monomeric Composition/Perfume)

7.3 g of TEOS-NCO (3(triethoxysilyl)propylisocyanate) were dissolved in 10 g of the perfume with the composition of Table 1, then heated to 60° C. While keeping this oil phase under stirring, 0.56 g of 1,2-diaminopropane were added dropwise and let to react for 30 min at 60° C. The temperature of the oil phase was then increased to 80° C. 0.86 g of 1,2-diaminocyclohexane were added dropwise and let to react for 30 min at 80° C.

Microcapsules According to the Invention

An aqueous phase was prepared by dissolving cationic polyvinyl alcohol, POVAL C506 from Kurary at 3% in water. The pH of this solution was increased to 11 by adding ammonia solution. The oil phase containing the polyalkoxysilane macro-monomeric composition and the water phase were heated separately to 80° C. 1.87 g of oil phase was then dispersed into 6.02 g of the aqueous phase by using Ultra Turrax at 24000 RPM for 30 s, at pH of 8.4. The pH of the emulsion was then adjusted to 10. The emulsion was kept under slow magnetic stirring for 3 h at 80° C. The pH of the emulsion was controlled (8.5) and adjusted to 10. After 2 h at 80° C., the stirring was stopped and the system was kept at room temperature.

The average size of microcapsules measured using the Sysmex FPIA-3000 (Malvern Instruments, UK) was close to 10 μm.

FIG. 1 shows microcapsules according to the invention as observed by Scanning Electron Microscopy before and after gentle rubbing. This figure positively illustrates the rigidity/friability of the membrane.

Example 2

Preparation of Microcapsules According to the Invention & Perfume Retention Measurements Preparation of the Oil Phase (Polyakoxysilane Macro-Monomeric Composition/Perfume):

9.73 g of TEOS-NCO (3(triethoxysilyl)propylisocyanate) were dissolved in 10 g of perfume with composition as described in Table 1, then heated to 60° C. While keeping this oil phase under stirring, 0.378 g of 1,2-diaminopropane were added dropwise and let to react for 30 min at 60° C. The temperature of the oil phase was then increased to 80° C. 1.14 g of 1,2-diaminocyclohane were added dropwise and let to react for 30 min at 80° C.

Microcapsules According to the Invention:

2.17 g of the oil phase were heated to 80° C. and then dispersed into 5.94 g of an aqueous emulsifier solution (cationic polyvinyl alcohol, POVAL C506 from Kurary 3%, 80° C.) by using high shearing equipment. The pH of the emulsion was adjusted to 10. The emulsion was kept at 80° C. under magnetic stirring for 3 h. The pH of the emulsion was adjusted again to 10. After 2 h at 80° C., the stirring was stopped and the system was kept at room temperature. The average size of microcapsules was close to 9 μm.

Perfume Retention from Microcapsules According to the Invention

Microcapsules prepared as described above were assessed for their perfume retention performance by Thermogravimetric analysis as described below.

Solid content and perfume retention were assessed using a thermogravimetric analyzer (TGA, Mettler-Toledo, Switzerland) equipped with a microbalance having an accuracy of 1 μg and a 35 mL oven. The microcapsule sample (10 to 20 mg) was introduced into an aluminium oxide crucible and its remaining mass was weighed by TGA under controlled temperature and a constant flow of nitrogen of 20 mL/min. The sample was heated from 25° C. to 50° C. at a rate of 5° C./min then the temperature was kept constant for about two hours.

Figure 2:
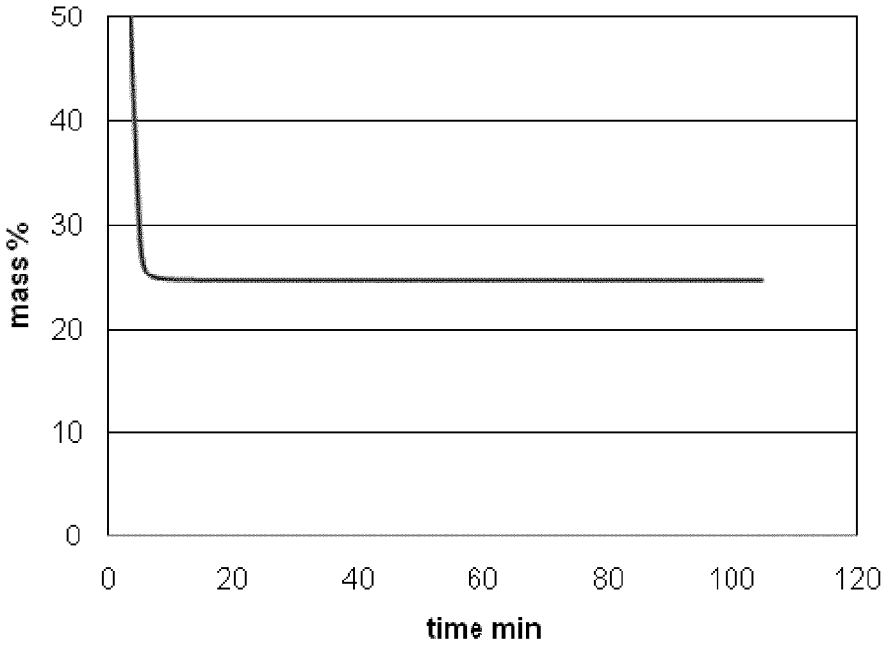
FIG. 2 illustrates the perfume retention of microcapsules from example 2 assessed by Thermogravimetric analysis when the temperature is fixed at 50° C.

Results are shown in FIG. 2. The first drop in % mass corresponds to water evaporation. That drop is followed by a plateau that illustrates that the microcapsules retain the perfume when their temperature is fixed at 50° C.

Example 3

Microcapsules According to the Invention

Preparation of Polyalkoxysilane Macro-Monomeric Composition/Perfume 7.3 g of TEOS-NCO (3(triethoxysilyl)propylisocyanate) were dissolved in 15 g of the perfume with the composition of Table 1, then heated to 60° C. While keeping this oil phase under stirring, 0.56 g of 1,2-diaminopropane were added dropwise and let to react for 30 min at 60° C. The temperature of the oil phase was then increased to 80° C. 0.86 g of 1,2-diaminocyclohexane were added dropwise and let to react for 30 min at 80° C.

Microcapsules According to the Invention:

An aqueous phase was prepared by dissolving cationic polyvinyl alcohol, POVAL C506 from Kurary at 3% in water. The pH of this solution was increased to 11 by adding an ammonia solution. The polyalkoxysilane macromonomers and aqueous solution were heated separately to 80° C. 26.71 g of the oil phase were dispersed into 53.41 g of the aqueous phase, by using Ultra Turrax at 24000 RPM for 30 s, at pH of 8.4. The pH of the emulsion was then adjusted to 10. The emulsion was kept under slow magnetic stirring for 3 h at 80° C. The pH of the emulsion was controlled (8.5) and adjusted to 10. After 2 h at 80° C., the stirring was stopped and the system was kept at room temperature.

The solid content of the microcapsules sample was 29% while the perfume content was 15%. The average size of microcapsules was close to 10 μm.

Example 4

Preparation of Microcapsules According to the Invention

Preparation of the Oil Phase (Polyakoxysilane Macro-Monomeric Composition/Perfume):

7.03 g of TEOS-NCO (3(triethoxysilyl)propylisocyanate) were dissolved in 10 g of perfume with composition as described in Table 1, then heated to 60° C. While keeping this oil phase under stirring, 0.56 g of 1,2-diaminopropane were added dropwise and let to react for 30 min at 60° C. The temperature of the oil phase was then increased to 80° C. 0.86 g of 1,2-diaminocyclohexane were added dropwise and let to react for 30 min at 80° C.

Microcapsules According to the Invention:

18.8 g of the oil phase were heated to 80° C. and then dispersed into 61.47 g of an aqueous emulsifier solution (cationic polyvinyl alcohol POVAL KL-506 from Kurary, 3%, 80° C.) by using high shearing equipment. The pH of the emulsion was adjusted to 10. The emulsion was kept at 80° C. under magnetic stirring for 3 h. The pH of the emulsion was adjusted again to 10. After 2 h at 80° C., the stirring was stopped and the system was kept at room temperature. The solid content was 20.7% while the average size of microcapsules was close to 10 μm.

Example 5

Preparation of Microcapsules According to the Invention

Preparation of the Oil Phase (Polyakoxysilane Macro-Monomeric Composition/Perfume):

6.08 g of TEOS-NCO (3(triethoxysilyl)propylisocyanate) were dissolved in 10 g of perfume with composition as described in Table 1, then heated to 60° C. While keeping this oil phase under stirring, 0.463 g of 1,2-diaminopropane were added dropwise and let to react for 30 min at 60° C. The temperature of the oil phase was then increased to 80° C. 0.71 g of 1,2-diaminocyclohexane were added dropwise and let to react for 30 min at 80° C.

Microcapsules According to the Invention:

1.76 g of the oil phase were heated to 80° C. and then dispersed into 6.3 g of an aqueous emulsifier solution (cationic polyvinyl alcohol, POVAL C506 3%, 80° C.) by using high shearing equipment. The pH of the emulsion was adjusted to 10. The emulsion was kept at 80° C. under magnetic stirring for 3 h. The pH of the emulsion was adjusted again to 10. After 2 h at 80° C., the stirring was stopped and the system was kept at room temperature. The solid content was 20.7% while the average size of microcapsules was close to 10 μm.

Example 6

Breakability of Capsules According to the Invention

General Protocol:

Force-displacement curves on single microcapsules were measured using a micromechanical probe instrument (FemtoTools, Switzerland) using a lateral force sensor. The measuring setup was mounted on an inverted microscope to allow positioning and observation of the mechanical probe tip. The capsules were deposited on microscope cover glasses from droplets of a dilute suspension and left to dry; to obtain this dilute suspension the original capsule slurry as described in the previous examples was diluted 100-fold in ultra-filtrated water. Force-displacement curves were measured in position-controlled mode by placing the force probe at a distance of 20-30 micrometers from the glass substrate and approaching the substrate at a speed of 100 nanometers per second; curves were performed as full cycles including an approach portion and a retract portion.

Figure 3:
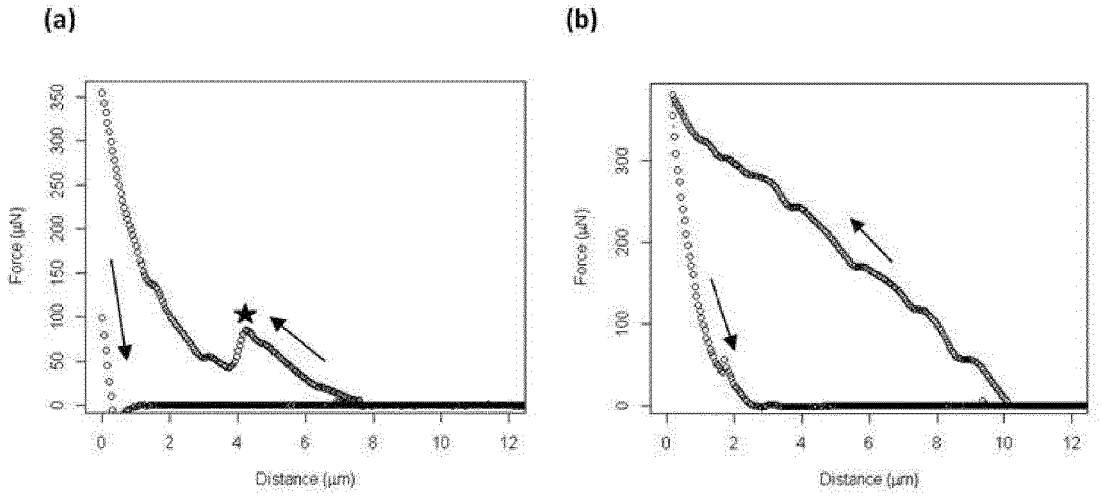
FIG. 3 represents force-displacement curves of microcapsules. (a) Microcapsules prepared according to the invention and (b) traditional polyurea microcapsules. Arrows indicate the direction of the compression (up) and retraction (down) parts of the experiments. The star symbol indicates a fracture event.

Force curves were measured for the microcapsules prepared according to invention (Examples 5). For comparison, identical force measurements were also performed on traditional polyurea microcapsules prepared according to the publication by Jacquemond M. et al. (J. Appl. Poly. Sc., 114(5), 3074-3080, 2009). A side-to-side comparison of the force curves is illustrated in FIG. 3. The microcapsules prepared according to the invention exhibit significantly different mechanical behaviour: the compression curve reveals a clear peak, identifying a rupture or burst event of the capsule. In contrast, the force curve of the traditional capsules merely increases upon compression but does not reveal rupture or burst events. This example therefore demonstrates that capsules prepared according to the invention are more easily breakable and are able to undergo sudden rupture within a desired range of compression forces, thereby releasing the encapsulated perfume. The microcapsules prepared according to the invention therefore offer more desirable mechanical characteristics as compared to the traditional capsules while also providing excellent storage stability to the encapsulated perfume.

Example 7

Preparation of Microcapsules According to the Invention & Perfume Retention Measurements Preparation of the Oil Phase (Polyalkoxysilane Macro-Monomeric Composition/Perfume):

7.30 g of TEOS-NCO (3(triethoxysilyl)propylisocyanate) were dissolved in 10 g of perfume with composition as described in table 1, and then heated to 50° C. While keeping this oil phase under stirring, 1,2-diaminopropane was added dropwise and let to react for 30 min at 50° C. Then 1,2-diaminocyclohexane was added dropwise and let to react for 30 min at 50° C. The temperature of the oil phase was then increased to 70° C. Two samples with different quantities of amine compounds (see Table 2) were studied in this example.

TABLE 2

| quantities of polyamines | | |
|---|---|---|
| Sample | 1-2diaminopropane | 1-2diaminocyclohexane |
| 1 | 0.28 g | 1.28 g |
| 2 | 0.83 g | 0.43 g |

Figure 4:
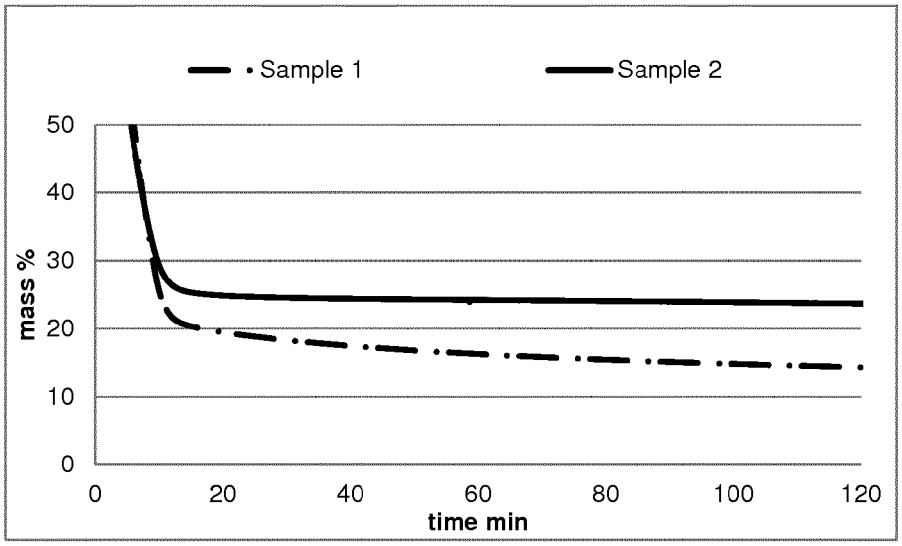
FIG. 4 illustrates the perfume retention of microcapsules from example 7 assessed by Thermogravimetric analysis when the temperature is fixed at 50° C.

Microcapsules According to the Invention:

An aqueous phase was prepared by dissolving cationic polyvinyl alcohol POVAL KL506 at 3% in water. The pH of this solution was increased to 11 by adding ammonia solution. The oil phase containing polyalkoxysilane macro-monomeric composition and water phase were heated to 80° C. 9.13 g of the oil phase was then dispersed into 35.57 g of aqueous phase by using Ultra Turrax at 24000 RPM for 2 min, at pH closed to 6. The pH of the emulsion was then adjusted to 10. The emulsion was kept under slow magnetic stirring for 3 h at 80° C. The pH of the emulsion was controlled and adjusted to 10. After 2 h at 80° C., the stirring was stopped and the system was kept at room temperature. The average size of microcapsules was closed to 10 μm. As shown in FIG. 4, the perfume retention depends on the ratio between the two amino compounds.

Example 8

Preparation of Microcapsules According to the Invention & Perfume Retention Measurements Preparation of the Oil Phase (Polyalkoxysilane Macro-Monomeric Composition/Perfume):

7.30 g of TEOS-NCO (3(triethoxysilyl)propylisocyanate) were dissolved in 10 g of perfume with composition as described in Table 1, then heated to 60° C. While keeping this oil phase under stirring, 0.18 g of 1,2-diaminopropane were added drop-wise and let to react for 30 min at 60° C. The temperature of the oil phase was then increased to 80° C. 1.14 g of 1,2-diaminocyclohexane were added drop-wise and let to react for 30 min at 80° C. 0.27 g of tris(2-aminoethyl)amine—were added drop-wise and let to react for 30 minutes at 80° C.

Figure 5:
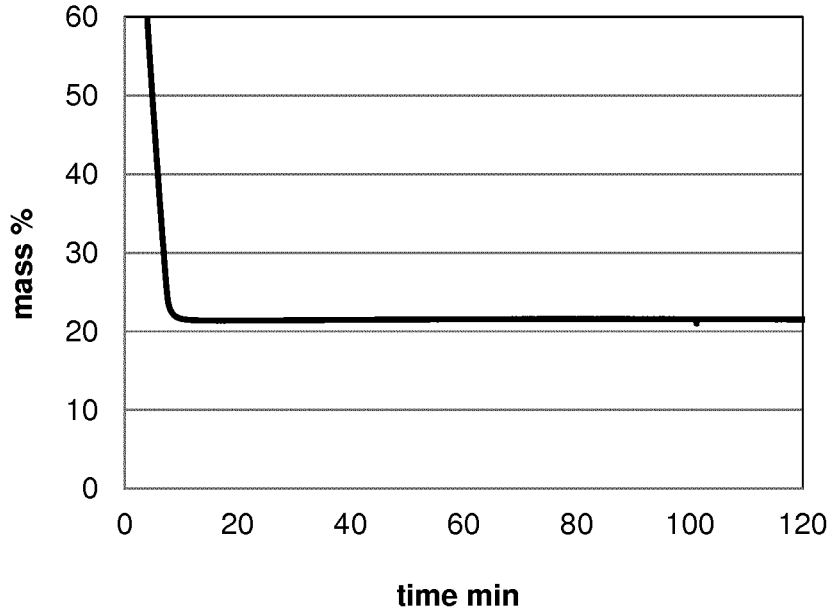
FIG. 5 illustrates the perfume retention of microcapsules from example 8 invention assessed by Thermogravimetric analysis when the temperature is fixed at 50° C.

Microcapsules According to the Invention:

9.49 g of the oil phase were heated to 80° C. and then dispersed into 30.64 g of an aqueous emulsifier solution (cationic polyvinyl alcohol POVAL KL-506 3%, 80° C.) by using high shearing equipment. The pH of the emulsion was adjusted to 10. The emulsion was kept at 80° C. under magnetic stirring for 3 h. The pH of the emulsion was adjusted again to 10. After 2 h at 80° C., the stirring was stopped and the system was kept at room temperature. The solid content was 20.8% while the average size of microcapsules was close to 10 μm. The microcapsules show excellent perfume retention at 50° C. as illustrated in FIG. 5.

Example 9

Preparation of Microcapsules According to the Invention & Perfume Retention Measurements Preparation of the Oil Phase (Polyalkoxysilane Macro-Monomeric Composition/Perfume):

7.30 g of TEOS-NCO (3(triethoxysilyl)propylisocyanate) were dissolved in 10 g of perfume with composition as described in Table 1, then heated to 60° C. While keeping this oil phase under stirring, 0.18 g of 1,2-diaminopropane were added dropwise and let to react for 30 min at 60° C. The temperature of the oil phase was then increased to 80° C. 0.28 g of 1,2-diaminocyclohexane were added dropwise and let to react for 30 min at 80° C. 1.10 g of tris(2-aminoethyl)amine were added dropwise and let to react for 30 min at 80° C.

Figure 6:
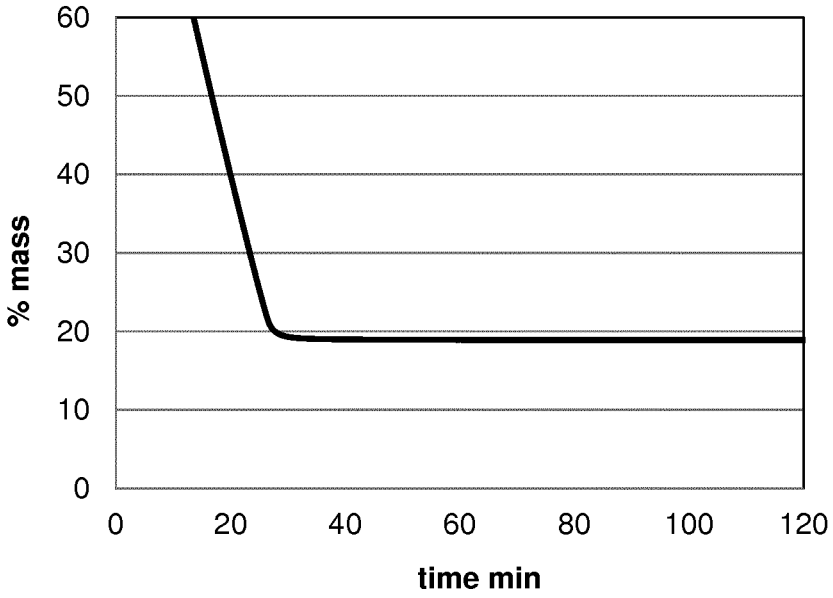
FIG. 6 illustrates the perfume retention of microcapsules from example 9 assessed by Thermogravimetric analysis when the temperature is fixed at 50° C.

Microcapsules According to the Invention:

9.44 g of the oil phase were heated to 80° C. and then dispersed into 30.62 g of an aqueous emulsifier solution (cationic polyvinyl alcohol POVAL KL-506 3%, 80° C.) by using high shearing equipment. The pH of the emulsion was adjusted to 10. The emulsion was kept at 80° C. under magnetic stirring for 3 h. The pH of the emulsion was adjusted again to 10. After 2 h at 80° C., the stirring was stopped and the system was kept at room temperature. The solid content was 20.72% while the average size of microcapsules was close to 10 μm. The thermogravimetric analysis of microcapsules shows excellent perfume retention at 50° C. as illustrated in FIG. 6.

Example 10

Preparation of Microcapsules According to the Invention & Perfume Retention Measurements Preparation of the Polyalkoxysilane in a Solvent (Polyalkoxysilane Macro-Monomeric Composition/Solvent)

4.91 g of TEOS-NCO (3(triethoxysilyl)propylisocyanate) were dissolved in 8.11 g of triethylcitrate, then heated to 60° C. While keeping this oil phase under stirring, 0.38 g of 1,2-diaminopropane were added dropwise and let to react for 30 min at 40° C. 0.58 g of 1,2-diaminocyclohexane were added dropwise and let to react for 30 min at 40° C. The temperature of the oil phase was then increased to 70° C.

Figure 7:
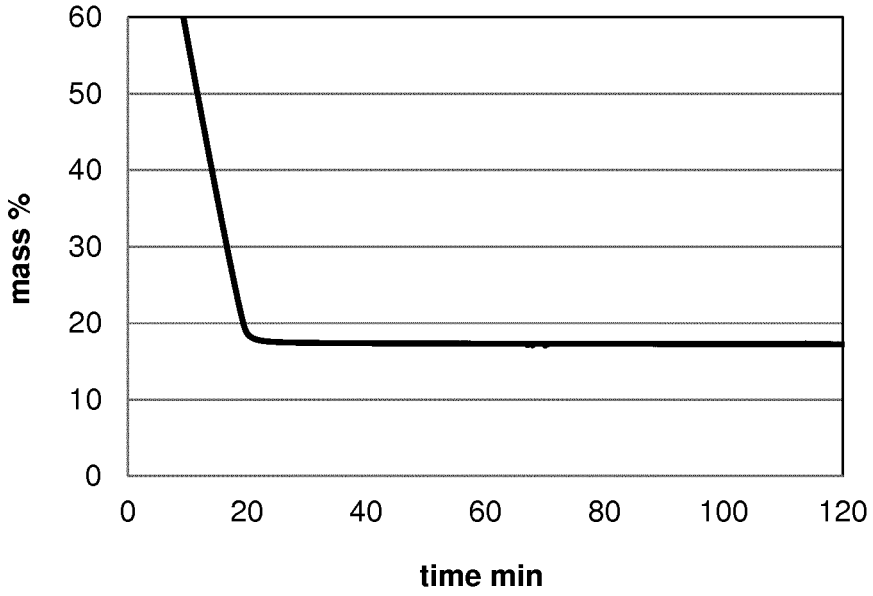
FIG. 7 illustrates the perfume retention of microcapsules from example 10 assessed by Thermogravimetric analysis when the temperature is fixed at 50° C.

Microcapsules According to the Invention:

An aqueous phase was prepared by dissolving Lignosulfonic acid sodium salt (from Aldrich) at 3% in water. The pH of this solution was increased to 11 by adding ammonia solution. 0.60 g of polyalkoxysilane macro-monomeric composition was added to 1.06 g of perfume described in Table 1, then heated to 70° C. The water phase was heated separately to 70° C. 1.67 g of the oil phase was then dispersed into 5.99 g of the aqueous phase by using Ultra Turrax at 24000 RPM for 30 s, at pH closed to 7. The pH of the emulsion was then adjusted to 10. The emulsion was kept under slow magnetic stirring for 3 h at 80° C. The pH of the emulsion was controlled and adjusted to 10. After 2 h at 80° C., the stirring was stopped and the system was kept at room temperature. The solid content was 18.9% while the average size of microcapsules was close to 15 μm. Thermogravimetric analysis of these microcapsules showed excellent perfume retention at 50° C. as illustrated in FIG. 7.

Example 11

Preparation of Organic-Inorganic Hybrid Microcapsules According to the Invention

TABLE 3

| perfume composition | |
|---|---|
| Ingredients | Amount [%] |
| Allyl (cyclohexyloxy)-acetate[a)] | 1.2 |
| 2,4-Dimethyl-3-cyclohexene-1-carbaldehyde[b)] | 1.2 |
| Menthone | 1.7 |
| Hedione ®[c)] | 5.8 |
| Camphor | 2.9 |
| Eucalyptol | 5.8 |
| Dihydromyrcenol[d)] | 11.5 |
| Rose oxyde | 0.9 |
| Isobornyl acetate | 11.5 |

TABLE 3-continued

| perfume composition | |
|---|---|
| Ingredients | Amount [%] |
| Delta damascone | 0.6 |
| Cashmeran ®[e)] | 2.3 |
| Terpenyl acetate | 5.8 |
| Lilial ®[f)] | 17.0 |
| Linalyl acetate | 2.3 |
| Neobutenone ® alpha[g)] | 1.2 |
| Dihydromyrcenyl acetate | 2.3 |
| 2-Methylundecanal | 3.5 |
| Iso E Super ®[h)] | 11.5 |
| Cetalox ®[i)] | 0.6 |
| Isoraldeine ® 70[j)] | 2.3 |
| Habanolide ®[k)] | 4.6 |
| Precyclemone B[l)] | 3.5 |
| Total | 100.0 |

[a)]Origin: Dragoco, Holzminden, Germany
[b)]Origin: Firmenich SA, Geneva, Switzerland
[c)]Methyl dihydrojasmonate, origin and trademark from Firmenich SA, Geneva, Switzerland
[d)]Origin: International Flavors & Fragrances, USA
[e)]1,2,3,5,6,7-Hexahydro-1,2,3,3-pentamethyl-4h-inden-4-one, origin and trademark from International Flavors & Fragrances, USA
[f)]3-(4-Tert-butylphenyl)-2-methylpropanal, origin and trademark from Givaudan SA, Vernier, Switzerland
[g)]1-(5,5-Dimethyl-1-cyclohexen-1-yl)-4-penten-1-one, origin and trademark from Firmenich SA, Geneva, Switzerland
[h)]1-(Octahydro-2,3,8,8-tetramethyl-2-naphtalenyl)-1-ethanone, origin and trademark from International Flavors & Fragrances, USA
[i)]Dodecahydro-3a,6,6,9a-tetramethyl-naphtho[2,1-b]furan, origin and trademark from Firmenich SA, Geneva, Switzerland
[j)]3-Methyl-4-(2,6,6-trimethyl-2cyclohexen-1-yl)-3-buten-2-one, origin and trademark from Givaudan SA, Vernier, Switzerland
[k)]Pentadecenolide, origin and trademark from Firmenich SA, Geneva, Switzerland
[l)]1-Methyl-4-(4-methyl-3-pentenyl)cyclohex-3-ene-1-carboxaldehyde, origin: International Flavors & Fragrances, USA Preparation of the Oil Phase (Polyalkoxysilane Macro-Monomeric Composition/Perfume)

7.30 g of TEOS-NCO (3(triethoxysilyl)propylisocyanate) were dissolved in 10 g of perfume with composition as described in table 3, then heated to 50° C. While keeping this oil phase under stirring, 0.56 g of 1,2-diaminopropane were added dropwise and let to react for 30 min at 50° C. 0.86 g of 1,2-diaminocyclohexane were added dropwise and let to react for 30 min at 50° C. The temperature of the oil phase was then increased to 70° C.

Figure 8:
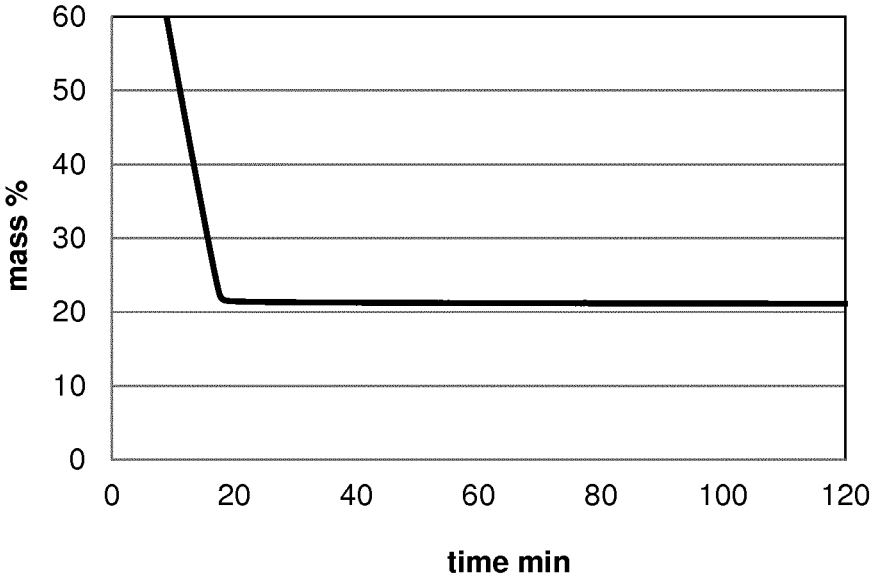
FIG. 8 illustrates the perfume retention of microcapsules from example 11 assessed by Thermogravimetric analysis when the temperature is fixed at 50° C.

Microcapsules According to the Invention:

An aqueous phase was prepared by dissolving Lignosulfonic acid sodium salt (from Aldrich) at 1% in water and the Superstab AA Gum Arabic, from Nexira at 1% of in water. The pH of this solution was increased to 11 by adding ammonia solution. The oil phase containing the polyalkoxysilane macro-monomeric composition and water phase were heated to 80° C. 2.11 g oil phase was then dispersed into 5.99 g of aqueous phase by using Ultra Turrax at 24000 RPM for 30 s, at pH closed to 7. The pH of the emulsion was then adjusted to 10. The emulsion was kept under slow magnetic stirring for 3 h at 80° C. The pH of the emulsion was controlled and adjusted to 10. After 2 h at 80° C., the stirring was stopped and the system was kept at room temperature. The solid content was 22.4% while the average size of microcapsules was close to 15 μm. Thermogravimetric analysis of these microcapsules showed excellent perfume retention at 50° C. as illustrated in FIG. 8.

Example 12

Reproduction of the Example 1 of the US Patent Referenced US2011/0118161 A1.

Figure 9:
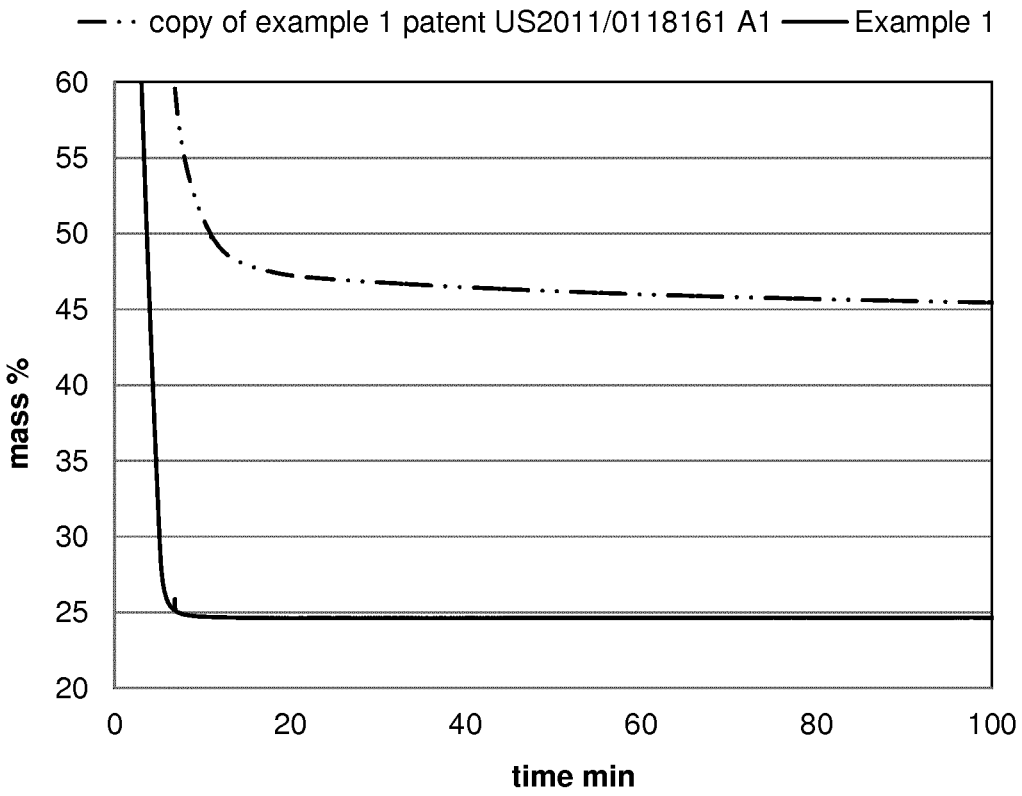
FIG. 9 illustrates the perfume retention of microcapsules from example 12 assessed by Thermogravimetric analysis when the temperature is fixed at 50° C.

The Example 1 of the patent referenced US2011/0118161 A1 was reproduced with Desmodur N100 instead of Desmodur N3300 and the perfume described in table 1. FIG. 9 shows a comparison in term of perfume retention between the resulting capsules and the ones obtained according to Example 1 of the present invention. Although these microcapsules are obtained with higher solid content, they don't retain the perfume that is leaking continuously at 50° C. The microcapsules of the present invention present excellent perfume retention showed by the perfect plateau in FIG. 9.

What is claimed is:

1. A polyalkoxysilane macro-monomeric composition obtainable by reacting at least one compound of formula

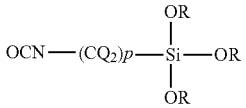

(i)

wherein NCO is an isocyanate group, R represents a $CH_3$ or a $CH_2$—$CH_3$ group; Q represents a hydrogen, a $CH_3$ or a $CH_2$—$CH_3$ group and p is an integer comprised between 1 and 5;

with at least two different polyamines comprising each at least two amino groups.

2. A polyalkoxysilane macro-monomeric composition according to claim 1, wherein the molar ratio of isocyanate group(s) from the at least one compound of formula (i) relative to the amino groups from the at least two polyamines is comprised between 0.8 and 2.

3. A polyalkoxysilane macro-monomeric composition according to claim 1 wherein at least one compound of formula (i) is selected from the group consisting of 3(triethoxysilyl)propyl isocyanate and 3(trimethoxysilyl)propyl isocyanate.

4. A polyalkoxysilane macro-monomeric composition according to claim 1 wherein at least two different polyamines each comprise two amino groups.

5. A polyalkoxysilane macro-monomeric composition according claim 1 wherein at least two different polyamines each comprise more than two amino groups.

6. A polyalkoxysilane macro-monomeric composition according to claim 4 wherein the at least two different polyamines are selected from the group consisting of 1,2-diaminopropane, 1,2-diaminocyclohexane, ethylenediamine, isobutylenediamine, and N,N'-dimethyl-1-2-diaminocyclohexane.

7. A process for the preparation of organic-inorganic core-shell microcapsules, said process including the following steps:

a) Dissolving a polyalkoxysilane macro-monomeric composition as defined in claim 1 into an active ingredient to form an oil phase;

b) Preparing an aqueous phase by dissolving an emulsifier or a colloidal stabilizer in water, at pH above 8;

c) Dispersing under high shearing the oil phase into the aqueous phase; and d) Keeping the resulting emulsion at pH above 8 and temperature higher than 60° C. to form hybrid microcapsules.

8. A process according to claim 7 for the preparation of organic-inorganic core-shell microcapsules comprising a fragrance-based core, said process including the following steps:

a) Dissolving a polyalkoxysilane macro-monomeric composition as defined in claim 1 into a perfume to form an oil phase;

b) Preparing an aqueous phase by dissolving an emulsifier or a colloidal stabilizer in water, at pH above 8;

c) Dispersing under high shearing the oil phase into the aqueous phase; and d) Keeping the resulting emulsion at pH above 8 and temperature higher than 60° C., to form hybrid microcapsules.

9. A process according to claim 7 wherein the polyalkoxysilane macro-monomeric composition represents from 1 to 50% of the oil phase.

10. A process according to claim 7 wherein the colloidal stabilizer is a cationic polymer.

11. Organic-inorganic core-shell microcapsules obtainable by a process as defined in claim 7 wherein said microcapsules comprise a fragrance-based core and a shell resulting from the hydrolysis and condensation reaction of the polyalkoxysilane macro-monomeric composition.

12. A liquid aqueous composition comprising microcapsules as defined in claim 11, together with a cationic polymer.

13. A perfuming composition or a perfumed consumer product comprising microcapsules as defined in claim 11.

14. A consumer product according to claim 13, in the form of a home- or personal-care product.

15. A consumer product according to claim 14, in the form of a shower gel, a hair care product, an antiperspirant or a deodorant.

16. A perfuming composition or a perfumed consumer product comprising a liquid composition as defined in claim 12.

17. A consumer product according to claim 16, in the form of a home- or personal-care product.

18. A consumer product according to claim 17, in the form of a shower gel, a hair care product, an antiperspirant or a deodorant.

* * * * *